US009643141B2

(12) United States Patent
Kershaw et al.

(10) Patent No.: US 9,643,141 B2
(45) Date of Patent: May 9, 2017

(54) SHAKEABLE CONTAINER WITH AGITATOR

(71) Applicant: TRIMR, LLC, Salt Lake City, UT (US)

(72) Inventors: Kasey Kershaw, Holladay, UT (US); Gary Moore, Salt Lake City, UT (US); Travis Winn, Salt Lake City, UT (US)

(73) Assignee: TRIMR, LLC, Murray, UT (US)

( * ) Notice: Subject to any disclaimer, the term of this patent is extended or adjusted under 35 U.S.C. 154(b) by 583 days.

(21) Appl. No.: 13/662,169

(22) Filed: Oct. 26, 2012

(65) Prior Publication Data

US 2014/0119154 A1 May 1, 2014
US 2016/0184785 A9 Jun. 30, 2016

Related U.S. Application Data

(60) Provisional application No. 61/552,308, filed on Oct. 27, 2011.

(51) Int. Cl.

| | |
|---|---|
| ***B01F 13/00*** | (2006.01) |
| ***B01F 11/00*** | (2006.01) |
| ***B01F 15/00*** | (2006.01) |
| ***B01F 3/08*** | (2006.01) |
| ***B01F 3/12*** | (2006.01) |

(52) U.S. Cl.

CPC ..... *B01F 13/0022* (2013.01); *B01F 3/08* (2013.01); *B01F 3/12* (2013.01); *B01F 11/0082* (2013.01); *B01F 15/00512* (2013.01); *B01F 2215/0022* (2013.01)

(58) Field of Classification Search

CPC ..... B01F 13/0022
USPC ..... 366/129, 130, 247, 308; 220/705, 220/707–709

See application file for complete search history.

(56) References Cited

U.S. PATENT DOCUMENTS

| | | | | | |
|---|---|---|---|---|---|
| 2,484,391 | A | * | 10/1949 | Treiss, Jr. | A47J 43/27 141/297 |
| 2,613,107 | A | * | 10/1952 | Hartnett | A47G 21/181 239/33 |
| 2,766,022 | A | * | 10/1956 | Bender | A47J 43/07 277/420 |
| D181,143 | S | | 10/1957 | Gundelfinger | |
| 3,136,532 | A | * | 6/1964 | Rudnick | 366/130 |
| 3,315,405 | A | * | 4/1967 | Hoffer | 446/71 |
| 4,134,494 | A | * | 1/1979 | Wong | A47G 21/187 206/216 |
| 4,408,690 | A | * | 10/1983 | Ferrero | 206/222 |
| 4,472,063 | A | * | 9/1984 | Eickelmann | B01F 7/00391 366/129 |
| 4,737,036 | A | * | 4/1988 | Offermann | 366/130 |
| 4,930,652 | A | * | 6/1990 | Murphy et al. | 220/706 |
| 5,065,909 | A | * | 11/1991 | Pino | B65D 47/305 215/229 |

(Continued)

FOREIGN PATENT DOCUMENTS

| | | | |
|---|---|---|---|
| CN | 101227850 | A | 7/2008 |
| CN | 101801250 | A | 8/2010 |

(Continued)

*Primary Examiner* — Abbas Rashid
(74) *Attorney, Agent, or Firm* — Workman Nydegger

(57) ABSTRACT

A hand-held shake-able container that includes an agitator connected to a straw that is used for the mixing of powder and liquid, or differing viscosity liquids.

16 Claims, 15 Drawing Sheets

(56) References Cited

U.S. PATENT DOCUMENTS 5,337,918 A * 8/1994 Wang ..... B65D 47/2012 215/229
5,393,258 A * 2/1995 Karterman ..... B65D 51/248 446/200
5,461,968 A 10/1995 Portman
5,908,126 A 6/1999 Wang
5,915,600 A 6/1999 Bitton
5,939,122 A 8/1999 Brady
D413,480 S 9/1999 Joergensen
D447,693 S 9/2001 Warner et al.
6,403,137 B1 * 6/2002 Frutin ..... 426/477
6,523,711 B1 * 2/2003 Hughes ..... A47G 19/2266 215/308
6,609,624 B2 * 8/2003 Goto et al. ..... 220/259.1
6,783,019 B2 * 8/2004 Zettle ..... B65D 43/0212 220/254.3
D510,678 S 10/2005 Krasne et al.
D557,978 S 12/2007 Bodum
D559,034 S 1/2008 Bodum
D571,610 S 6/2008 Bodum
7,441,941 B2 * 10/2008 Vernon ..... 366/130
7,533,783 B2 5/2009 Choi et al.
D611,764 S 3/2010 Wahl et al.
D642,434 S 8/2011 Schofield et al.
D655,967 S 3/2012 Bodum
D656,280 S 3/2012 St. Clair
D656,787 S 4/2012 Phillips et al.
8,191,727 B2 6/2012 Davies et al.
D665,222 S 8/2012 Cerasani
D675,110 S 1/2013 Myers
D676,278 S 2/2013 Wong
8,376,173 B2 * 2/2013 Britto et al. ..... 220/254.3
8,414,180 B1 * 4/2013 Mattingly et al. ..... 366/247
D682,034 S 5/2013 El-Saden et al.
8,469,226 B2 6/2013 Davies et al.
D687,259 S 8/2013 Hauser
8,505,783 B2 * 8/2013 Gill ..... A45F 3/20 215/388
8,822,209 B2 * 9/2014 Oldenburg ..... C12M 23/08 366/242
2002/0040909 A1 4/2002 Goto
2002/0048215 A1 * 4/2002 McGill ..... A47J 36/06 366/249
2004/0069783 A1 * 4/2004 Chen ..... A47G 19/2266 220/254.3
2006/0237489 A1 10/2006 De Lataulade
2006/0250887 A1 11/2006 Vernon
2008/0080299 A1 * 4/2008 Takumah ..... A47G 21/18 366/129
2008/0128529 A1 * 6/2008 Fernandez ..... A47G 21/181 239/33
2008/0259723 A1 * 10/2008 Rhodes ..... A47J 43/1018 366/247
2010/0127005 A1 * 5/2010 Sanbrook ..... A47G 19/2266 220/705
2010/0181329 A1 * 7/2010 Davies ..... A47G 19/2266 220/707
2010/0302897 A1 * 12/2010 George et al. ..... 366/130
2010/0308046 A1 12/2010 Serra
2011/0026360 A1 * 2/2011 Greller ..... B01F 7/00633 366/308
2011/0058447 A1 * 3/2011 Reif ..... B01F 7/1695 366/249
2011/0058448 A1 * 3/2011 Reif ..... B01F 7/16 366/250
2011/0059216 A1 3/2011 Takumah
2012/0325835 A1 * 12/2012 Merino ..... A47G 19/2211 220/705
2013/0010568 A1 * 1/2013 Bodum ..... 366/130
2013/0087571 A1 * 4/2013 Yao ..... A47G 21/18 220/709
2013/0126527 A1 * 5/2013 Chiu ..... A47G 19/2272 220/212
2013/0201783 A1 * 8/2013 Stewart ..... B01F 13/0022 366/130

FOREIGN PATENT DOCUMENTS

JP 2006-256622 A 9/2006
WO WO 2013/063535 5/2013

* cited by examiner

SHAKEABLE CONTAINER WITH AGITATOR

PRIORITY STATEMENT

The present application claims priority to U.S. Provisional Application No. 61/552,308 filed Oct. 27, 2011, entitled "Shakeable Container with Agitator".

BACKGROUND OF THE INVENTION

1. Field of the Invention

This present disclosure relates to an agitator used for the mixing of powder and liquid, or differing viscosity liquids, within a fully enclosed hand-held shakeable container.

2. Background and Related Art

There is a basic need to mix a liquid and powder, or to mix differing viscosities and/or density liquids. In some cases an agitator is used to more greatly homogenize a product prior to use, as in aerosol paint (typically a sealed aluminum or metal container with a non-removable agitator that is discarded after use). There is also a common and recurring need for the mixing of products for edible consumption. Such consumable products in need of mixture include baby formulas, nutritional and dietary supplements, powdered and liquid flavored drink mixes, pancake batters, medicinal products, etc. Powdered and/or differing density liquids are difficult to mix into a smooth and homogenous suspension. Without the use of an agitator as the catalyst to fully mix the ingredients, there is a common problem of clumping powders and suspended and non-mixed ingredients.

SUMMARY OF THE INVENTION

The present disclosure relates to an agitator used for the mixing of powder and liquid, or differing viscosity liquids, within a fully enclosed hand-held shakeable container. Implementation of the present device takes place in association with a shakeable container that includes, in some embodiments, a straw, agitator and lid. The ingredients requiring mixture are enclosed in the shakeable container. In some embodiments, the container is shaken in an up and down manner, causing the agitator to move up and down the affixed straw, bumping off the bottom of the lid and the flange at the bottom of the straw, increasing inertia from the springing motion to more rapidly and fully mix the contents with less effort. There are many alternative shapes and sizes of the lid, container and straw, other than those expressly disclosed herein. In addition, the length of the straw may vary to accommodate the size of the container it is affixed to.

While the methods and processes disclosed herein have proven to be particularly useful in the area of mixing liquid and powder, or to mix different viscosities and/or density liquids, those skilled in the art can appreciate that the methods and processes can be used in a variety of different applications and in a variety of different areas of manufacture to yield a mixed product. Certain embodiments may involve the mixing of the following non-limiting list: powdered drinks, electrolyte pills, energy drinks, baby formula, pancake batter, crepes, baking materials, salsa, sauces (hollandaise, gravy, etc.), oil and vinegar, salad dressings, smoothies, juices, coffee and creamer/flavorings, alcohol mixed drinks, medical-related substances (pills, laxatives, fiber drinks, etc), and non-edibles (paint, household cleaners, etc).

Some embodiments include a system of using a straw and agitator in conjunction with each other. In certain embodiments, the straw is affixed to the lid of the shakeable container and has a flanged base. In some embodiments, an agitator is connected to the straw. This keeps the agitator as part of a larger piece and lowers the number of independent parts. A common problem with a free and loose agitator is the propensity for them to fall through dishwasher trays into the cleaning mechanisms, and their propensity to be lost.

In various embodiments, the shape and makeup of the agitator may vary greatly (see FIG. 22 for a partial display of potential agitator shapes and configurations). The agitator may be built of plastic, metal, or any other material. In certain embodiments, the design of the agitator apparatus is that of an hourglass shape, constructed of a metal wire coiled in a manner to create this shape. In some embodiments, the construction of the metal coil creates several points of close contact with the straw to prevent binding, but is loose enough that it will flow freely when shaking the container to mix the contents.

In certain embodiments, the agitator moves freely up and down the straw to aid in creating a homogeneous mixture of the contents. Some embodiments feature a coiled design of the agitator that creates a spring effect that magnifies the inertia caused when shaking the container and works to lessen the effort needed and lower the time required to fully mix the contents of the container. The straw may be constructed of any material that will keep it rigid enough to allow the free movement of the agitator along the length of the straw. In some embodiments, the agitator moves along the entire length of the straw. In other embodiments, the agitator moves along less than the entire length of the straw. In some embodiments, the main body of the straw is to be linear and straight. In other embodiments, the main body of the straw is not straight but allows the agitator to move along the length of the straw in response to the shaking of the container.

In certain embodiments, the straw is affixed tightly to the container's lid creating a water/airtight seal. In some embodiments, this seal can be created by a pressed fit connection. In other embodiments, this seal can be created by a threaded fit connection. In some embodiments, the bottom portion of the straw has a flanged end. In certain embodiments, the flange serves as a base for the agitator to "spring" or "bounce" off of when the bottle is shaken, and also serves to keep the agitator from falling off the straw and becoming a loose and independent piece. In some embodiments, the flange touches the base of the container. In other embodiments, the flange does not touch the bottom of the container.

In some embodiments, the straw is made of plastic. In certain embodiments, the lid is constructed of a complimenting plastic material and, together, the lid and straw function to create a water and air tight seal. In some embodiments the straw and lid can be separated. However, in other embodiments, the straw and lid form one, unitary part.

In some embodiments, the construction of the lid is such that is has a common flip up apparatus that serves to seal the contents within the bottle when closed, or allow access to the contents of the bottle through sucking or pouring when open. In certain embodiments, when the straw attachment of the lid is closed, it works as a common valve to block access to the contents of the bottle and allows agitation without spilling. In some embodiments, when the straw is in an open position, the contents of the shakeable container can be sucked from the bottle. In certain embodiments, a common silicone grommet is used to create a water and airtight seal to prevent any spillage or decrease in sucking efficiency during consumption.

Some embodiments include a second opening on the lid. In certain embodiments, this second opening is larger than the opening or hollow portion of the straw. In some embodiments, this second opening is covered or closed by a common flip up top, or chug cap, that creates a water and air tight seal when closed, but allows for a "chug" or more rapid consumption of the contents of the bottle when open.

In some embodiments, the lid/straw combination is affixed to the bottle through a compression fit or threads, and utilizes a silicone washer to create a water and airtight seal with the base of the bottle.

These and other features and advantages of the present invention will be set forth or will become more fully apparent in the description that follows. The features and advantages may also be realized and obtained by means of the instruments and combinations particularly pointed out in the description that follows. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
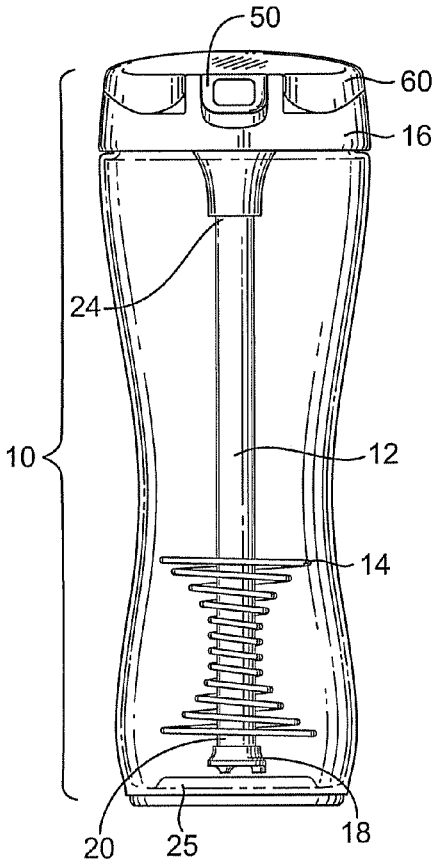
FIGS. 1 and 2 illustrate a representative shakeable container with an agitator and straw.

FIG. 1 shows an exemplary shakeable container 10 according to at least one embodiment. In some embodiments, shakeable container 10 includes a straw 12, agitator 14, and lid 16. In certain embodiments, the straw 12 includes a flange 18 located on a bottom portion 20 of the straw 12 and a threaded portion 22 (not shown) located on a top portion 24 of the straw 12.

In some embodiments, the agitator 14 is that of an hourglass shape, constructed of a metal wire coiled in a manner to create this shape. In certain embodiments, the agitator 14 creates several points of contact with straw 12 creating a connection with the straw 12 that allows the agitator 14 to move freely up and down straw 12 when the shakeable container 10 is shaken. In some embodiments, flange 18 is in contact with a base 25 of shakeable container 10. In other embodiments, flange 18 does not contact the base 25 of shakeable container 10.

FIG. 1 also shows a view of the shakeable container 10, where the shakeable container 10 has a flip-up straw 50 in closed position. In addition, FIG. 1 shows lid cover 60 in closed position.

Figure 2:
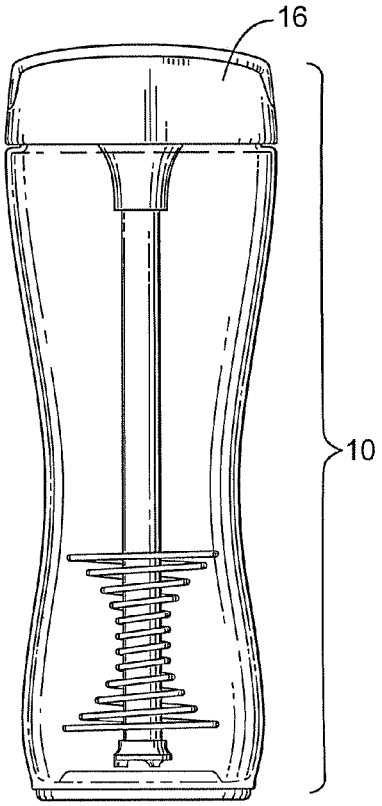

FIG. 2 shows an exemplary shakeable container 10 from the reverse side of FIG. 1. In particular, FIG. 2 shows lid 16 from the opposite view as is shown in FIG. 1. In this view, the flip-up straw 50 is not viewable because it is in closed position.

Figure 3:
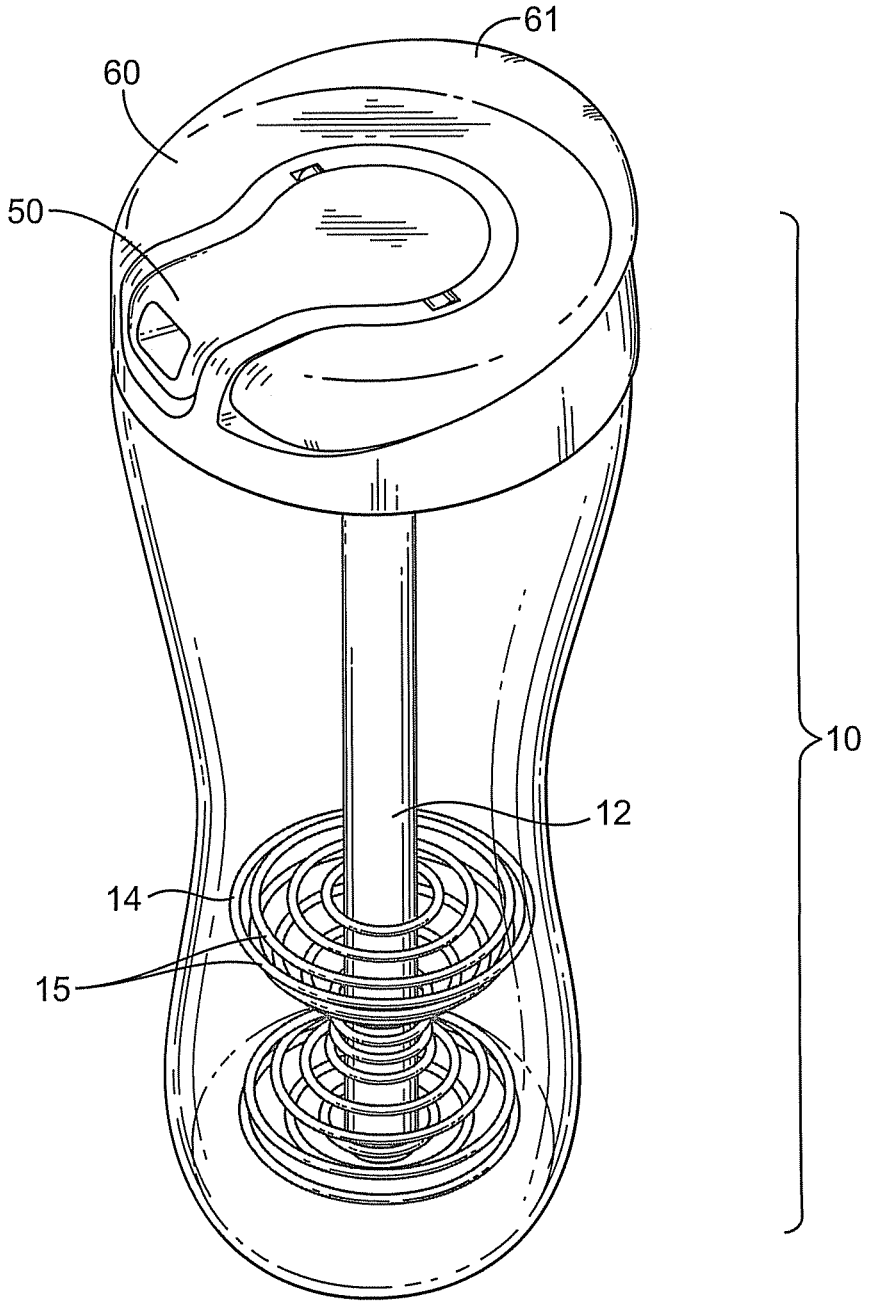
FIG. 3 illustrates a perspective view of a representative shakeable container with an agitator and straw.

FIG. 3 shows an exemplary shakeable container 10 in a perspective view. From this view, the agitator 14 is shown in an hour-glass shape where the separation of wires 15 of agitator 14 can be seen before they have been compressed. In this embodiment, the agitator 14 is positioned toward the bottom of the straw 12. FIG. 3 also shows flip-up straw 50 in closed position and lid cover 60 in closed position. In this embodiment of lid cover 60, lid cover 60 has a lip 61. In some embodiments, lid 61 serves as a handle or gripping device on which a user can place his or her hand to assist in opening the lid cover 60.

Figure 4:
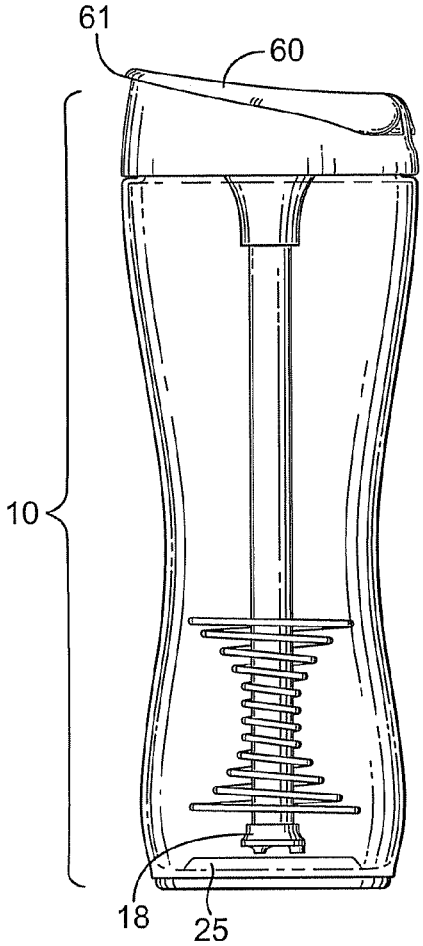
FIGS. 4 and 5 illustrate a representative shakeable container with an agitator and straw.
Figure 5:
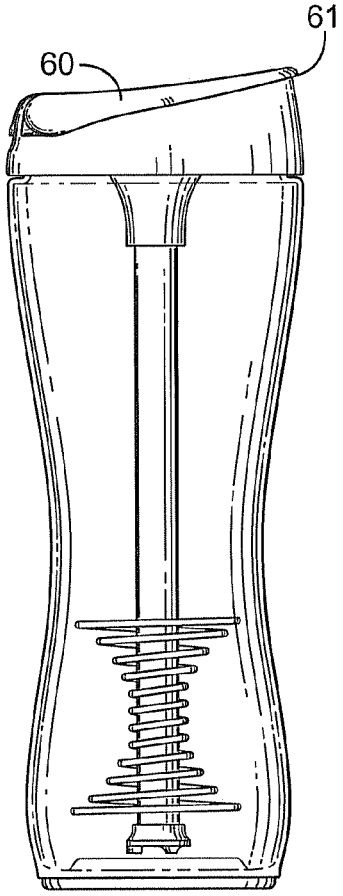

FIG. 4 shows shakeable container 10 from a side view where lip 61 of lid cover 60 is on the left side of shakeable container 10. This embodiment also shows that flange 18 does not contact the base 25 of shakeable container 10. Similarly, FIG. 5 shows the reverse side of shakeable container 10 where lip 61 of lid cover 60 is on the right side of shakeable container 10.

Figure 6:
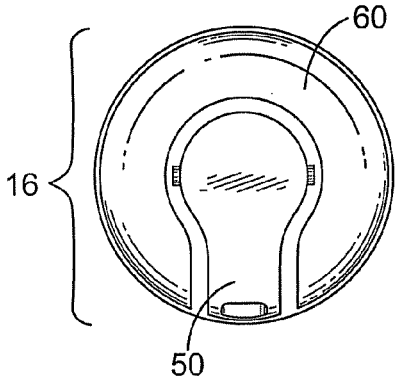
FIG. 6 illustrates a top view of a representative lid.

FIG. 6 is a top view of an embodiment of the lid 60 that shows the flip-up straw 50 in closed position and lid cover 60 in a closed position.

Figure 7:
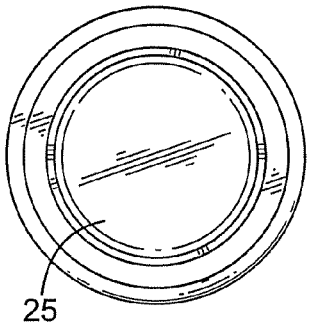
FIG. 7 illustrates a bottom view of the base.

FIG. 7 shows a bottom view of an embodiment of the shakeable container 10 that shows the bottom view of base 25.

Figure 8:
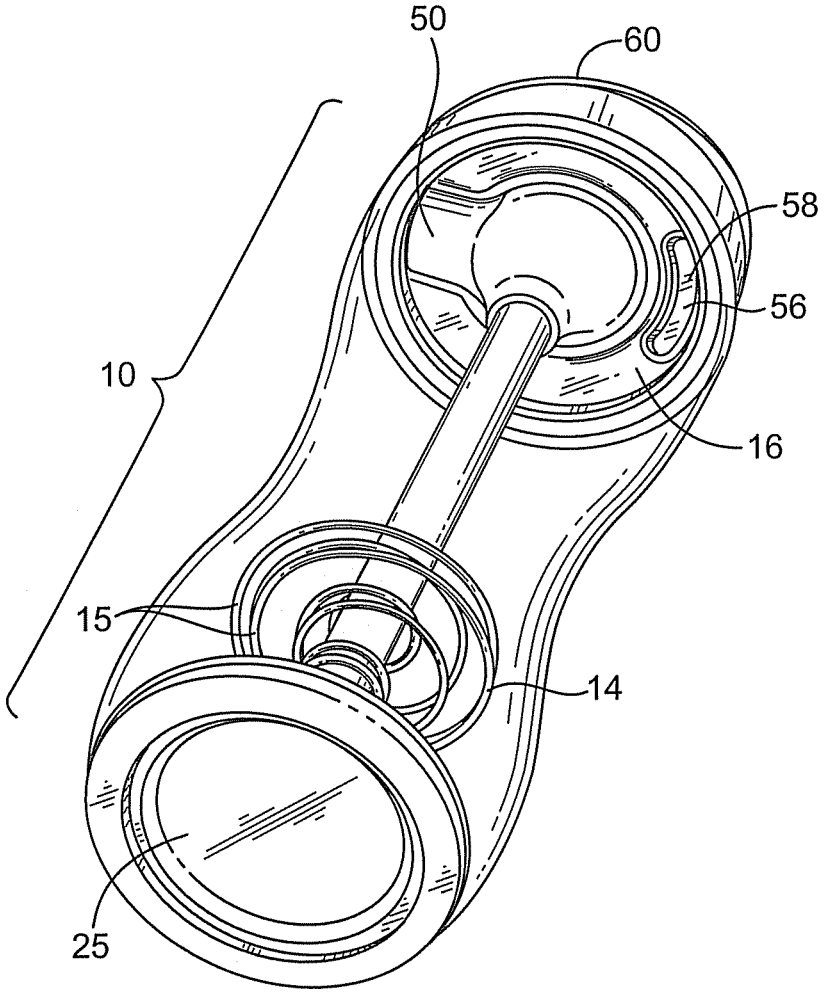
FIG. 8 illustrates a perspective view of a representative shakeable container with an agitator and straw.

FIG. 8 shows an embodiment of shakeable container 10 from a bottom perspective view. From this view, one can see the bottom side of base 25 as well as the bottom side of agitator 14 where space between wires 15 can be seen. In addition, FIG. 8 shows the underside of lid 16 where the underside of second opening 56 can also be seen including the bottom side of chug cap 58 when chug cap 58 is inserted into the second opening and where lid cover 60 is in closed position. In addition, FIG. 8 shows the underside of flip-up straw 50 in closed position. In this embodiment, the content, whether it is liquid or otherwise, of shakeable container 10 is secure and allows a user to freely and aggressively shake the exemplary shakeable container 10 without spilling the contents.

Figure 9A:
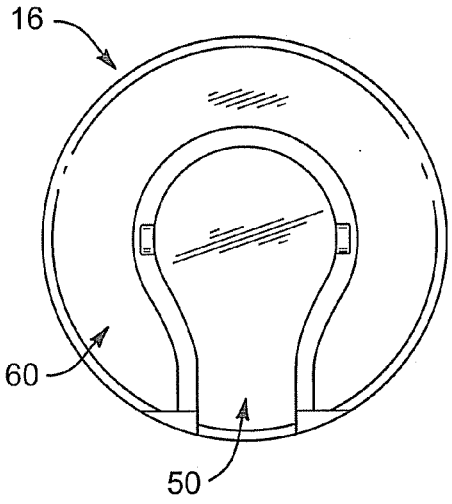
FIG. 9*a* is a top view of an embodiment of the lid with a flip-up straw in closed position and the lid cover.
Figure 9B:
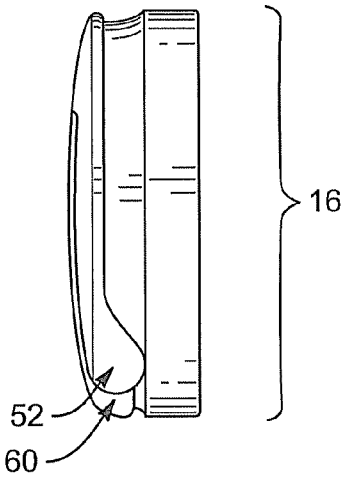
FIG. 9*b* is a side view of an embodiment of the lid that shows the flip-up straw in closed position and the lid cover.

FIG. 9*a* is a top view of an embodiment of the lid 16 that shows the flip-up straw 50 in closed position and lid cover 60. FIG. 9*b* is a side view of an embodiment of the lid 16 that shows the flip-up straw 50 in closed position and lid cover 60.

Figure 10:
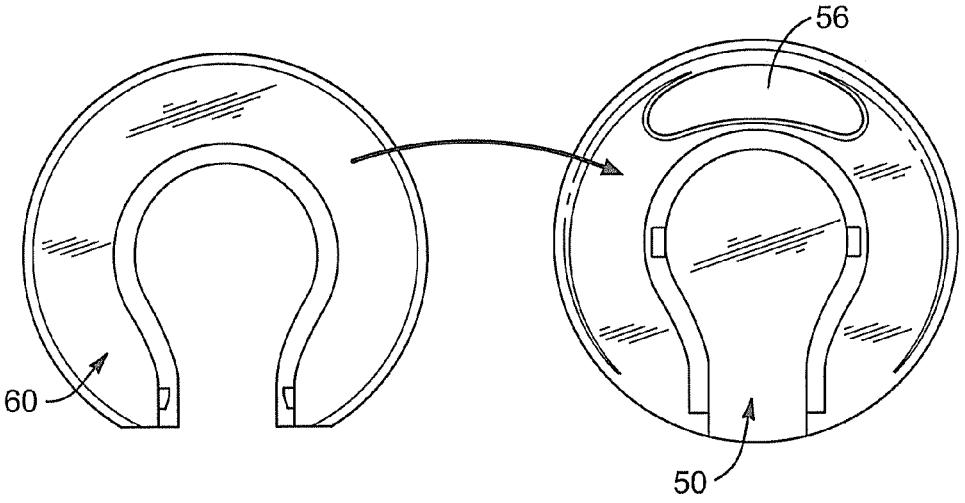
FIG. 10 shows the lid cover when removed from the lid and the second opening and flip-up straw in the closed position.

FIG. 10 is an embodiment that shows lid cover 60 when removed from lid 16. FIG. 10 also shows second opening 56 and flip-up straw 50 in closed position.

Figure 11:
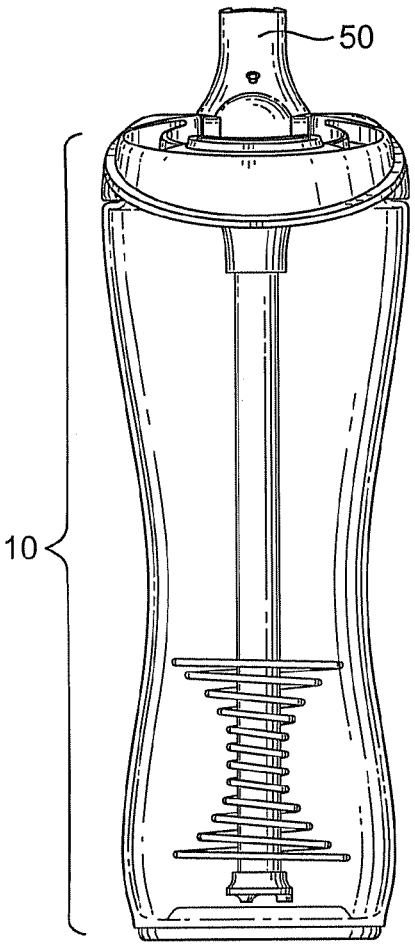
FIG. 11 illustrates a front view of the shakeable container where the flip-up straw is in open position.
Figure 12:
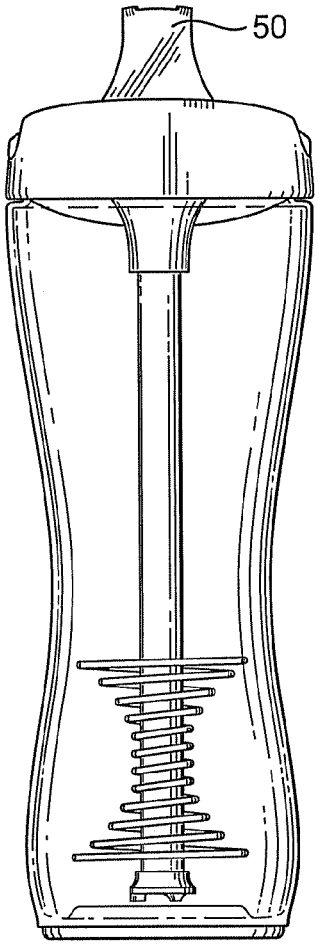
FIG. 12 illustrates a back view of the shakeable container where the flip-up straw is in open position.

FIG. 11 shows a front view of shakeable container 10 where flip-up straw 50 is in open position and where lid cover 60 is not attached. FIG. 12 shows the reverse side as is shown in FIG. 11 where flip-up straw 50 is also in open position.

Figure 13:
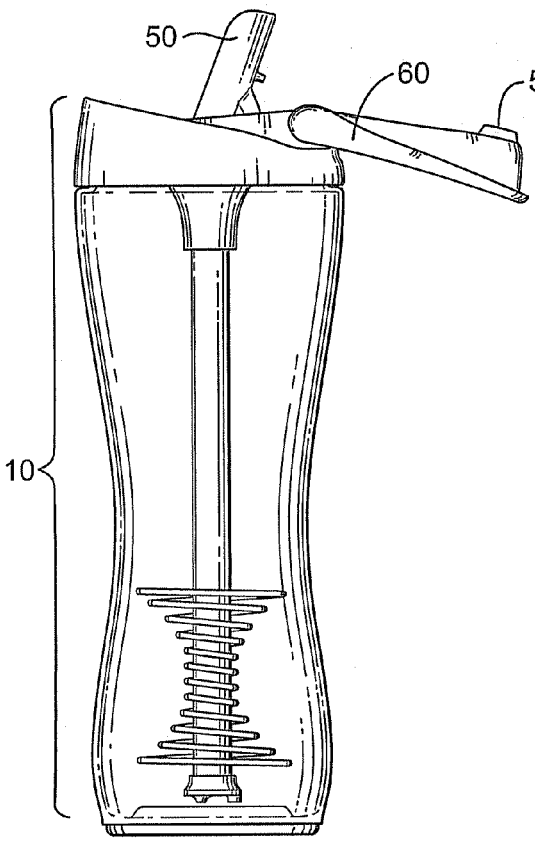
FIGS. 13 and 14 illustrate a side view of the shakeable container where lid cover is in open position and where flip-up straw is also in open position.
Figure 14:
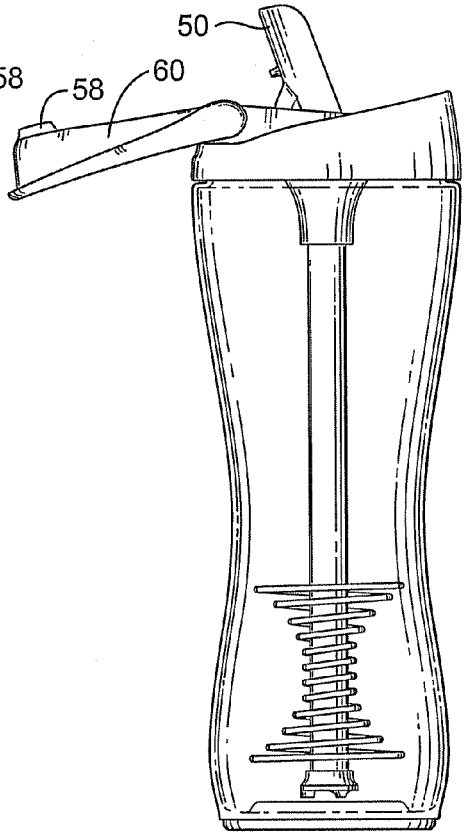

FIG. 13 shows a side view of shakeable container 10 where lid cover 60 is in open position and where flip-up straw 50 is also in open position. From this view, chug cap 58 can be seen. FIG. 14 shows the reverse view from FIG. 13 and similarly shows flip-up straw 50 in open position and lid cover 60 in open position, as well as chug cap 58.

Figure 15:
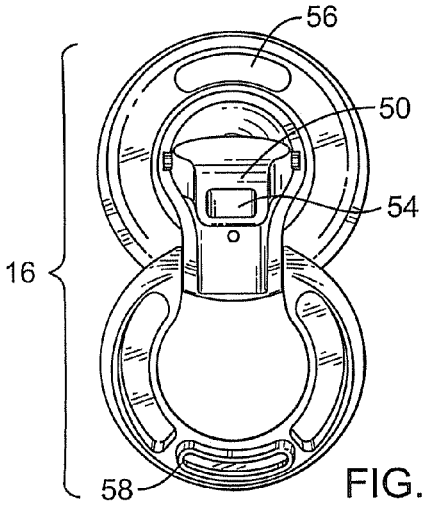
FIG. 15 shows the lid in open position.
Figure 16:
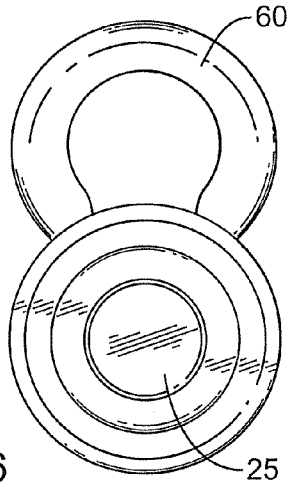
FIG. 16 illustrates the underside of the base and the topside of the lid when in open position.

FIG. 15 shows lid 16 in open position. FIG. 15 also shows the top view of second opening 56 and the bottom view of chug cap 58. In addition, FIG. 15 shows flip-up straw 50 in open position and inner straw channel 54. FIG. 16 shows the underside of base 25 and it shows the topside of lid cover 60, where lid cover 60 is in open position.

Figure 17:
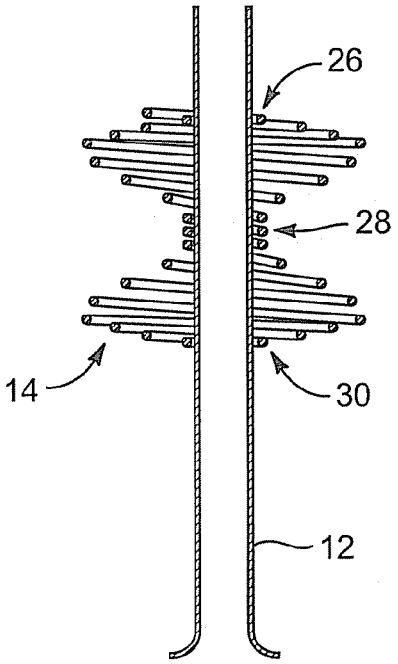
FIG. 17 illustrates a cut-away view of a representative straw and agitator.

FIG. 17 shows an embodiment of the agitator 14 in the context of a cut-away view of straw 12 where agitator 14 has a first contact point 26, a second contact point 28 and a third contact point 30 with straw 12. In certain embodiments, the three contact points allow the agitator to be coiled closely around the circumference of the straw 12 without being tightly affixed to the straw 12. This design shown in FIG. 17 serves to keep the agitator 14 from binding on the straw 12, but allows it to move freely up and down the straw 12 to aid in creating a homogeneous mixture of the contents. In addition, the coiled design of the agitator 14, as is shown in FIG. 17 creates a spring effect that magnifies the inertia created when shaking the shakeable container 10 and works to lessen the effort needed and lower the time required to fully mix the contents of the shakeable container 10.

Figure 18A:
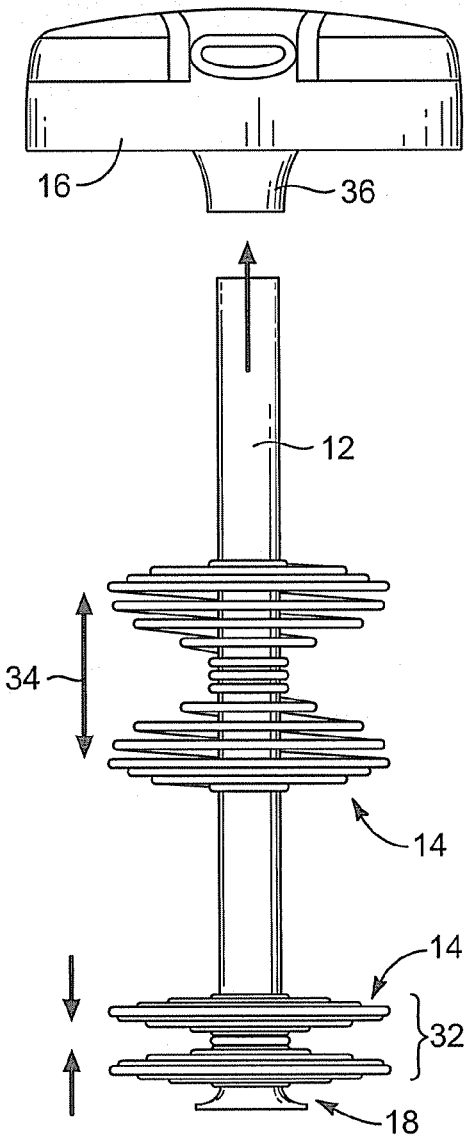
FIG. 18*a* illustrates a representative agitator together with a detachable straw and lid.

FIG. 18*a* shows various embodiments of agitator 14 as it moves up and down straw 12 because shakeable container 10 has been shaken. For example, in this embodiment, FIG. 18*a* shows agitator 14 in a compressed position 32 as agitator 14 is positioned near the bottom of straw 12 and near flange 18. In this embodiment, the flared shape of flange 18 functions to as a base for the agitator 14 to spring or bounce off of when shakeable container 10 is shaken, and also serves to keep the agitator from falling off the straw and becoming a loose and independent piece.

FIG. 18*a* also shows agitator 14 in an expanded position 34. In certain embodiments, when agitator 14 reaches the top of straw 12 near to or touching the lid 16, agitator 14 goes into compressed position 32.

FIG. 18*a* also shows that in various embodiments straw 12 is affixed to lid 16 creating a watertight and airtight seal. In certain embodiments, this seal is created by a pressed fit connection. In other embodiments, this seal between the straw 12 and lid 16 is created by a threaded fit connection. In some embodiments, straw 12 is connected to lid 16 via the straw-connector 36.

In some embodiments, the straw 12 may be constructed of any material that is rigid enough to hold its shape under the strain of shaking the shakeable container 10, easily cleanable and dishwasher safe, and hygienic enough to be used with ingestibles. In certain embodiments, the straw 12 is made of plastic.

In some embodiments, straw 12 and lid 16 can be separated, as is shown in FIG. 18*a*. In other embodiments, straw 12 and lid 16 form a singular part of shakeable container 10 and cannot be separated.

Figure 18C:
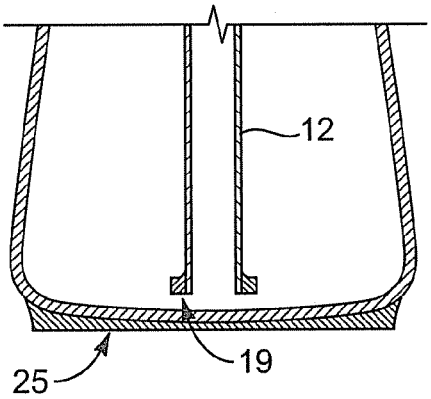
FIG. 18*c* illustrates a cut away view of the shakeable container.
Figure 18B:
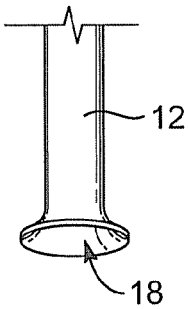
FIG. 18*b* illustrates a close up perspective view of the bottom of straw and flange.

FIG. 18*b* shows a close up perspective view of the bottom of straw 12 and flange 18.

FIG. 18*c* shows a cut away view of the shakeable container 10 that shows straw 12 with a ring 19 shown near the base of straw 12. In some embodiments, ring 19 functions to help keep the agitator 14 from falling off the end of the straw 12. FIG. 18*c* also shows an embodiment where straw 12 and ring 19 do not touch the base 25 of the shakeable container 10.

Figure 19:
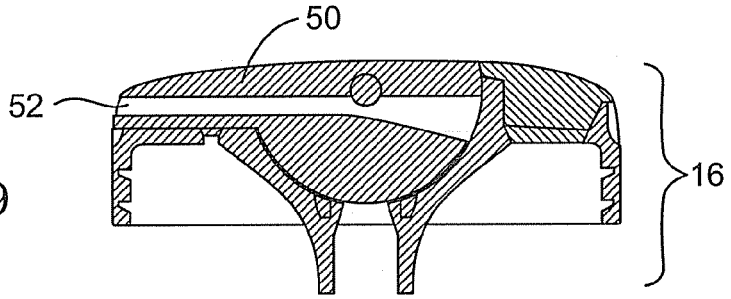
FIG. 19 illustrates an exemplary embodiment of the lid with the flip-up straw in a closed position.

FIG. 19 shows an exemplary embodiment of lid 16 with the flip-up straw 50 that includes a hollow portion 52 and shows flip-up straw 50 in a closed position. The contents of the shakeable container 10 are sealed within the shakeable container 10 when the flip-up straw 50 is in closed position. When closed, the flip-up straw 50 of the lid 16 works as a common valve to block access to the contents of the shakeable container 10 and allows agitation without spilling.

Figure 20:
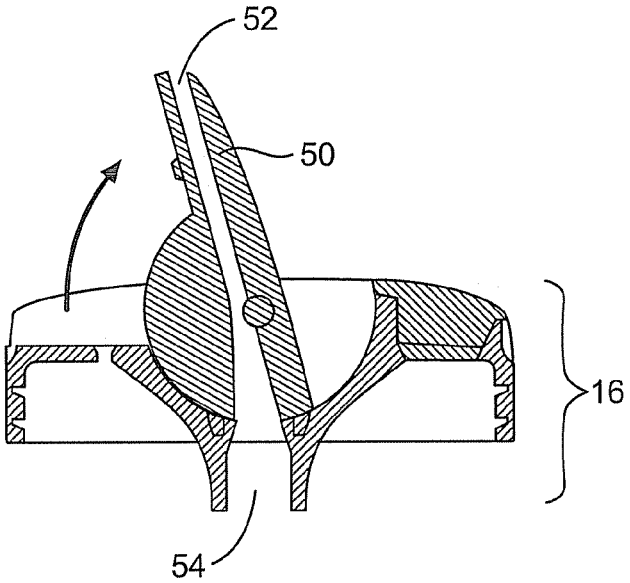
FIG. 20 illustrates an exemplary embodiment of the lid with the flip-up straw in an open position.

FIG. 20 shows an exemplary embodiment of lid 16 that shows the flip-up straw 50 in an open position. In this embodiment, hollow portion 52 is aligned with an inner straw channel 54, allowing fluid to flow through the inner straw channel 54 and hollow portion 52. In some embodiments, a user may access the contents of the shakeable container 10 through sucking when the flip-up straw 50 is in an open position.

Figure 21:
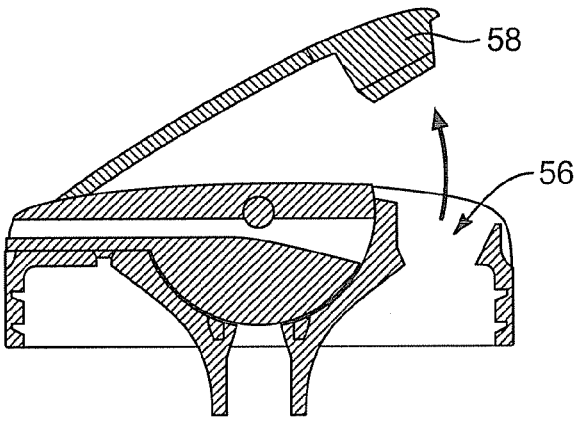
FIG. 21 illustrates an exemplary embodiment of the lid with a second opening and a chug cap.

FIG. 21 shows an embodiment that includes a second opening 56 and a chug cap 58. When secured in the second opening 56, the chug cap 58 creates a water tight and airtight seal. When the chug cap 58 is removed from the second opening 56, the user can drink from the shakeable container 10 by accessing the contents through the second opening 56. In some embodiments, the chug cap 58 is physically connected to the lid 16 even when in an open position. In certain embodiments, chug cap 58 can be opened via a flip-up top. In other embodiments, the chug cap 58 is completely removable from the lid 16.

Figure 22:
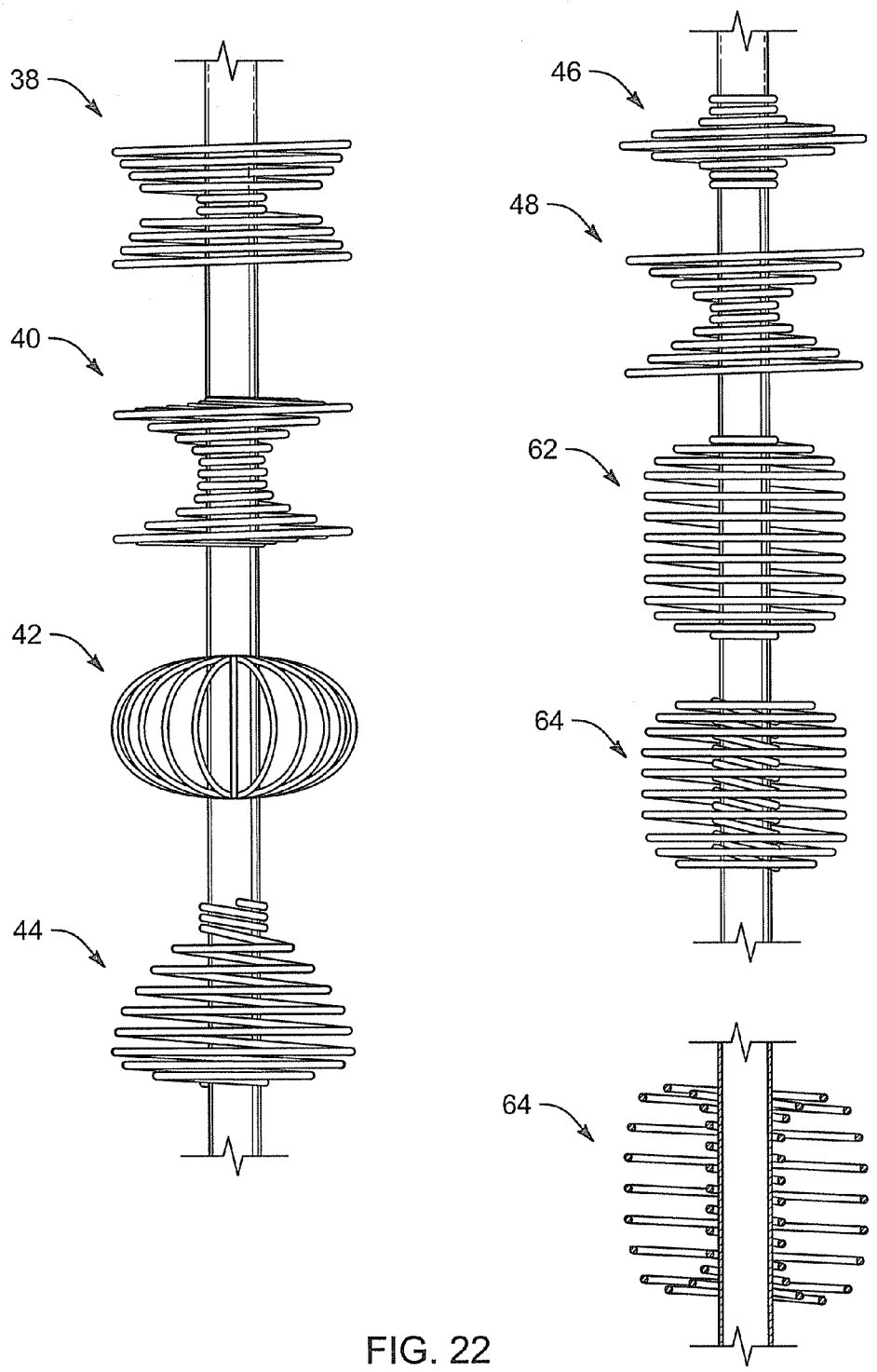
FIG. 22 illustrates various examples of agitators.

FIG. 22 shows examples of agitators 14 used in various embodiments. For example, FIG. 22 shows three examples of agitators shaped in an hourglass configuration as agitators 38, 40 and 48. Other shapes include: an oval-shaped agitator 42, where the equatorial diameter is greater than the polar diameter; triangular-shaped agitator 44; the inverse-hour glass agitator 46; substantially rectangular-shaped agitator 62, and continuous loop agitator 64. FIG. 22 also shows a cut-away view of continuous loop agitator 64.

Figure 23:
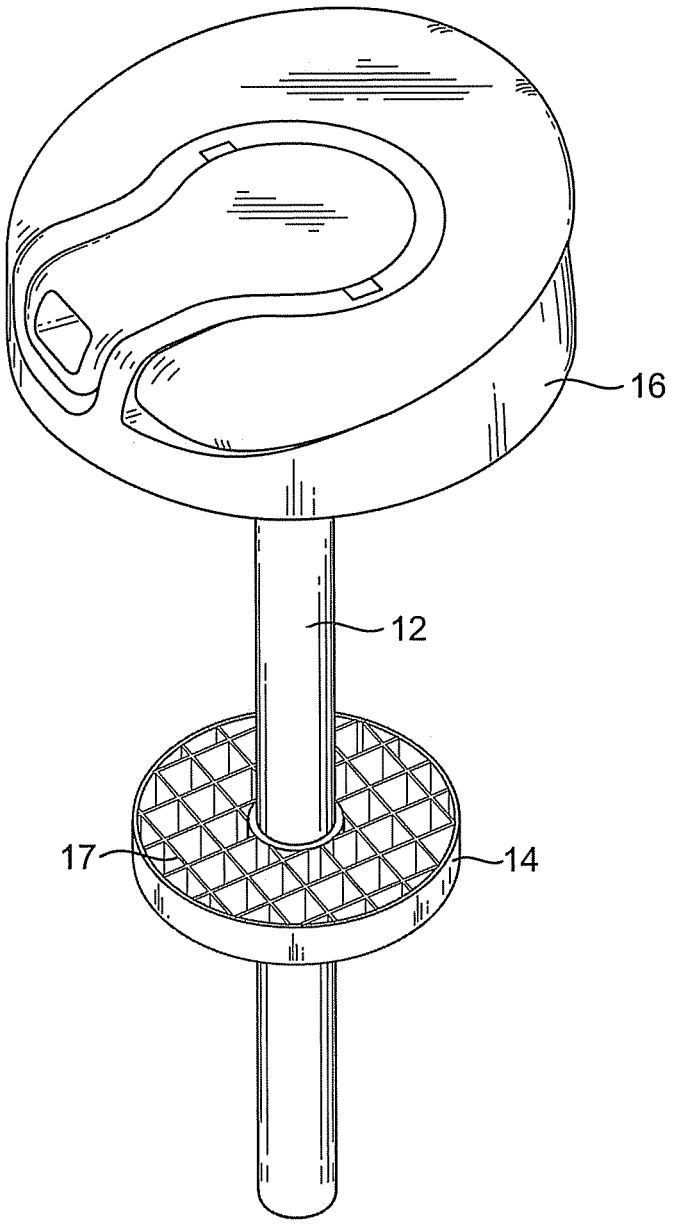
FIGS. 23 and 24 show selective portions of shakeable container.

FIG. 23 shows selective portions of shakeable container 10. In particular, FIG. 23 shows lid 16 in closed position, straw 12 and agitator 14. In this embodiment, agitator 14 as in the earlier embodiments may move along substantially the entire length of straw 12 or, alternatively, agitator 14 may remain in a fixed position relative to straw 12. Where agitator 14 remains in a fixed position, the contents of shakeable container 10 moves through the grids 17 of agitator 14 when a user shakes shakeable container 10.

Figure 24:
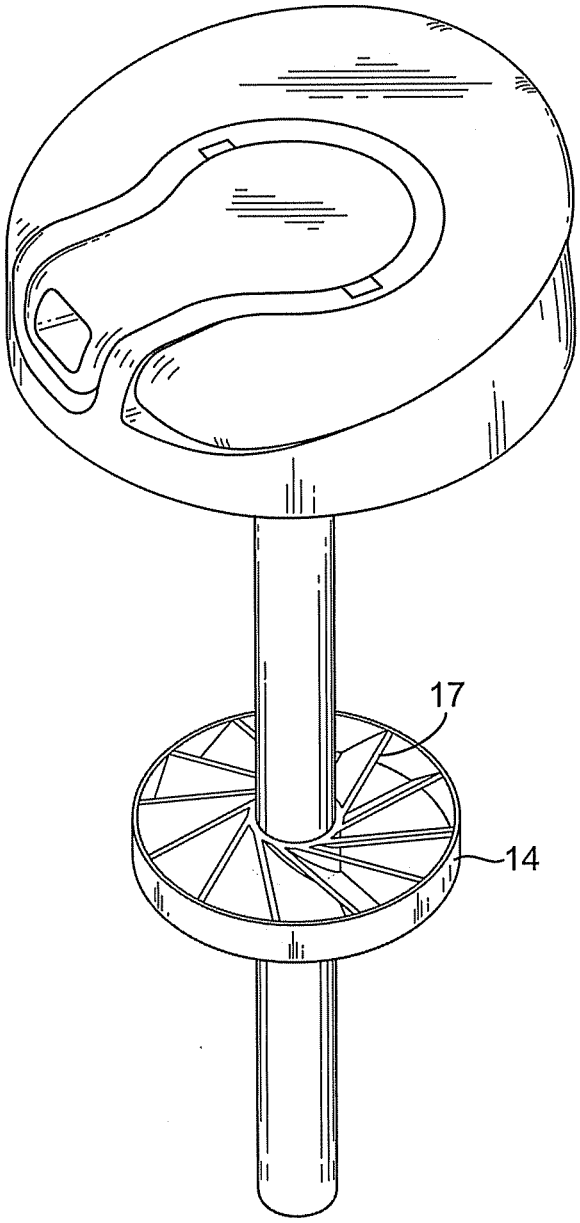

FIG. 24 shows an alternative embodiment of agitator 14 where grids 17 are slanted.

Figure 25:
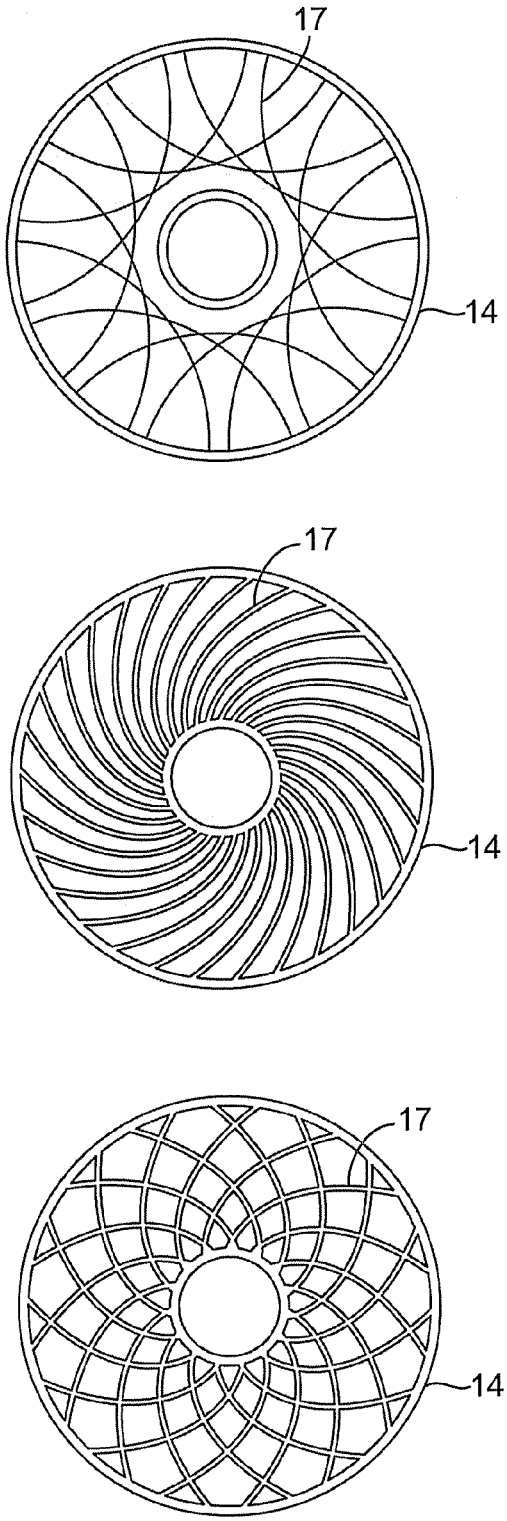
FIG. 25 shows examples of various shapes of grids.

FIG. 25 shows examples of various shapes of grids 17 that are also effective in mixing the contents of shakeable container 10.

Figure 26:
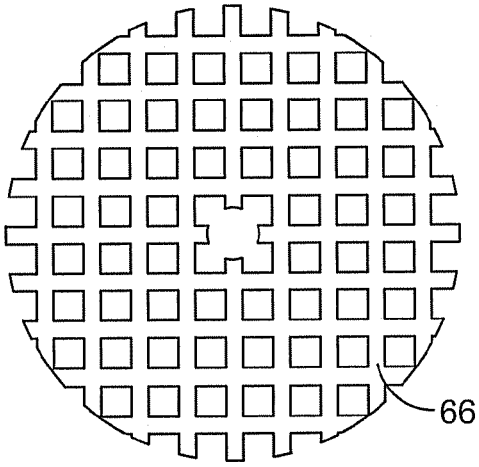
FIG. 26 shows a mesh screen through which the straw runs.
Figure 26:
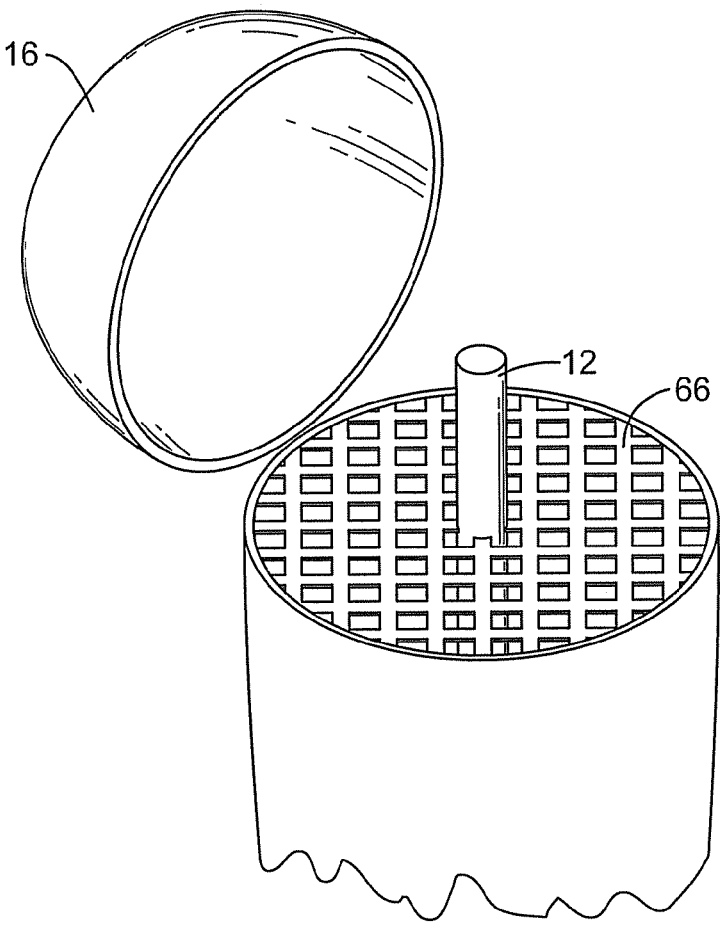

FIG. 26 is an embodiment that shows a mesh screen 66 through which straw 12 runs. In this embodiment, mesh screen 66 is shaped as a grid. However, in other embodiments, mesh screen 66 may be shaped in any other shape or configuration. FIG. 9 also shows lid 16 in an open position.

Figure 27:
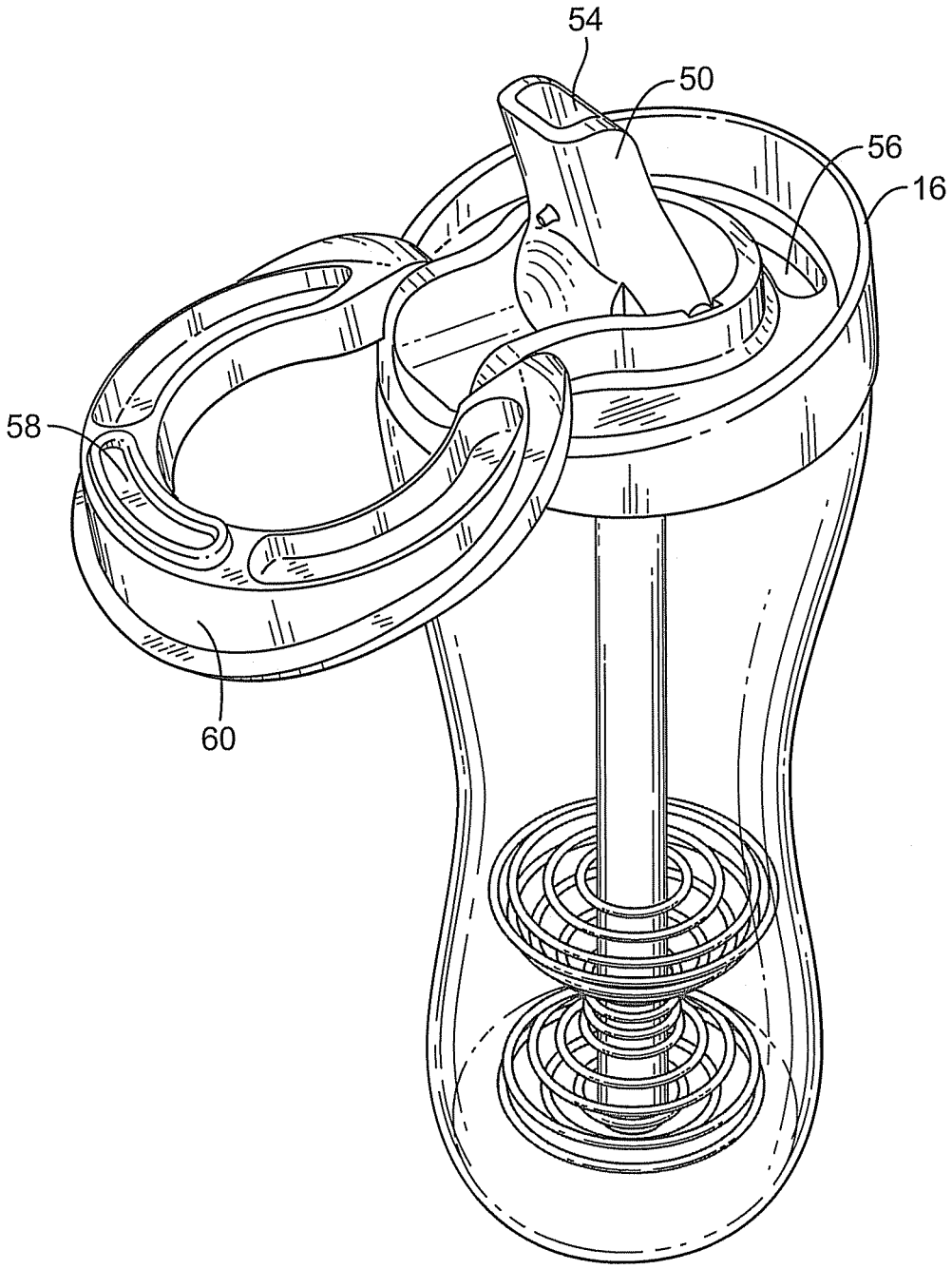
FIG. 27 shows a perspective view of the shakeable container.

FIG. 27 shows a perspective view of shakeable container 10 where lid 16 is in open position. In this view, not only is flip-up straw 50 shown in open position but also lid cover 60 is shown in open position. FIG. 27 also shows second opening 56, where chug cap 58 is not inserted into second opening 56. If the flip-up straw 50 were closed, one could access the content of shakeable container 10 by drinking out of the second opening 56. If lid cover 60 were in closed position, a user could access the contents of shakeable container 10 by drinking out of flip-up straw 50 because fluid would be able to exit shakeable container 10 by traveling out inner straw channel 54.

Thus, as discussed herein, the embodiments of the present invention embrace a shakeable container that includes, in some embodiments, a straw, agitator and lid.

The present invention may be embodied in other specific forms without departing from its spirit or essential characteristics. The described embodiments are to be considered in all respects only as illustrative and not restrictive.

What is claimed is:

1. A shakeable container comprising:

a container having a closed bottom and an interior;

a lid removably connected to the container, wherein the lid further comprises:

a flip-up straw associated with a straw opening in the lid, the flip-up straw being rigid and straight, the flip-up straw being rotatable between an open position where a proximal end of the flip-up straw is selectively aligned with a straw in the container, and a closed position where the proximal end of the flip-up straw is rotated out of alignment with the straw in the container no that fluid communication is provided between the straw and the proximal end of the flip-up straw in the open position and no fluid communication is provided between the straw and the proximal end of the flip-up straw in the closed position, wherein the proximal end of the flip-up straw is a lower end of the flip-up straw when the lid is connected to the container; and a lid cover that selectively covers a chug opening extending t irough the lid, the chug opening being distinct, separate from, and located at a distance from the straw opening, the chug opening providing fluid communication between an exterior of the lid and the interior of the container so as to allow a beverage within the container to be poured through the chug opening when the lid cover and chug opening are open;

the straw having opposed open ends, the straw being removably connected to the lid at a top open end of the straw so as to be aligned with the proximal end of the flip-up straw when the flip-up straw is in the open position, the straw having a flange at or near a bottom end of the straw, with the straw having an open end at the bottom end of the straw, the straw extending vertically from the lid towards the closed bottom of the container; and an agitator slidably connected to the straw, an interrelationship between the agitator and the straw being such that the agitator is movable longitudinally from at or near a top portion of the straw to at or near the flange.

2. The shakeable container of claim 1, wherein the flip-up straw includes a channel therein, the flip-up straw being rotatable such that as the ftip-up straw is rotated to the open position, the channel therein remains straight as it rotates from a position in which the proximal end of the flip-up straw is out of alignment with the top end of the straw to a position in which the proximal end of the flip-up straw is aligned with the top end of the straw to be in fluid communication with the straw.

3. The shakeable container of claim 1, wherein the agitator is shaped like an hourglass.

4. The shakeable container of claim 1, wherein the agitator has one of the following shapes: an oval-shape, where an equatorial diameter is greater than a polar diameter; a triangular-shape; an inverse-hour glass shape; a substantially rectangular-shape; or a continuous loop shape.

5. The shakeable container of claim 1, wherein the lid cover includes a chug cap for insertion into the chug opening extending through the lid.

6. The shakeable container as in claim 1, wherein the straw is connected to the lid via interlocking threads.

7. The shakeable container as in claim 1, wherein the straw is connected to the lid via a press fit connection.

8. The shakeable container as in claim 1, wherein the straw is connected to the lid such that the connection creates a watertight and airtight seal therebetween.

9. The shakeable container as in claim 1, wherein the straw and lid are inseparable.

10. The shakeable container as in claim 1. wherein the flange is flared.

11. The shakeable container as in claim 1, wherein the straw opening and the chug opening are different sizes with the chug opening having a larger cross-sectional surface area as compared to that of the straw opening to allow more rapid consumption of a beverage in the container than where the beverage is sipped through the flip-up straw.

12. The shakeable container as in claim 1, wherein the container comprises an upper portion, a middle portion, and a lower portion and wherein the upper portion and the lower portion have a greater circumference than the middle portion.

13. The shakeable container as in claim 1, wherein the straw extends to a location near, but not in contact with, the closed bottom of the container when the top end of the straw is connected to the lid.

14. The shakeable container as in claim 1, wherein in the closed position a distal sipping end of the flip-up straw is seated in a recess in an exterior surface of the lid at a perimeter edge of the lid with a top surface of the flip-up straw being received in the recess in the lid so as to present a flush surface across the top surface of the flip-up straw and adjacent exterior top surfaces of the lid; and wherein the chug opening in the lid extends through the lid and into the container at a location that is opposite from the recess in the exterior surface of the lid into which the flip-up straw is seated when the flip-up straw is in the closed position.

15. The shakeable container as in claim 14, Wherein the lid cover that selectively covers the chug opening is hingedly attached to the lid on either side of the recess in the exterior of the lid into which the flip-up straw is sealable, the flip-up straw and adjacent exterior top surfaces of the lid presenting a flush surface across the top surface of the flip-up straw and the adjacent exterior top surfaces of the lid so as to provide a flush, generally planar top surface across the flip-up straw and the adjacent exterior top surfaces of the lid when the lid cover is closed and the flip-up straw is in the closed position.

16. A shakeable container comprising:

a container having a closed bottom and an interior;

a lid removably connected to the container, the lid comprising:

a straw opening in the lid associated with a rotatable rigid flip-up straw of the lid that is selectively rotatable between an open position in which a proximal end of the flip-up straw is selectively aligned with the straw opening and a closed. position in which the proximal end of the flip-up straw is rotated out of alignment with the straw opening, so that fluid communication is provided between the straw opening and the proximal end of the flip-up straw in the open position, and no fluid communication is provided between the straw opening and the proximal end of the flip-up straw in the closed position, wherein the proximal end of the flip-up straw is a lower end of the flip-up straw when the lid is connected to the container; and a chug opening extending through the lid into the container, so as to provide fluid communication between the exterior of the lid and the interior of the container through the chug opening when the chug opening is open, wherein the chug opening is distinct, separate from, and located at a distance from the straw opening, wherein the chug opening has a larger cross-sectional surface area than the straw opening to allow for more rapid consumption of contents of the container when the chug opening is open as compared to sipping through the flip-up straw and the straw opening, the lid further comprising a chug cap that is selectively closable over the chug opening to selectively seal the chug opening when the chug cap is closed to prevent the contents of the container from being poured through the chug opening when the chug cap is closed;

a straw removably connected to the lid, the straw having an open top end removably connected to the lid, and an opposite bottom end, the bottom end having an enlarged flange with an open bottom end in the flange, wherein the open bottom end of the flange provides fluid communication to the top end of the straw, the straw extending vertically from the lid to a location near, but not in contact with the closed bottom of the container;

an agitator connected to the straw; and an air hole associated with the flip-up straw and straw opening, the air hole extending through the lid into the container so as to provide fluid communication between the exterior of the lid and the interior of the container through the air hole, the air hole being selectively closed when the flip-up straw is rotated to the closed position, and the air hole being selectively open when the flip-up straw is rotated to the open position, to allow air from outside the container to enter the container through the air hole.

* * * * *